US005130957A

United States Patent [19]

Nakabayashi

[11] Patent Number: 5,130,957

[45] Date of Patent: Jul. 14, 1992

[54] ELECTRONIC TIMEPIECE WITH TIMER

[75] Inventor: Yasushi Nakabayashi, Tokyo, Japan

[73] Assignee: Seiko Instruments Inc., Japan

[21] Appl. No.: 551,488

[22] Filed: Jul. 11, 1990

[30] Foreign Application Priority Data

Jul. 18, 1989 [JP] Japan ..... 1-186675

[51] Int. Cl.[5] ..... G04F 8/00

[52] U.S. Cl. ..... 368/110; 368/113

[58] Field of Search ..... 368/107-113

[56] References Cited

U.S. PATENT DOCUMENTS

| | | | |
|---|---|---|---|
| 4,166,360 | 9/1979 | Yamaguchi | 58/39.5 |
| 4,238,847 | 12/1980 | Daly | 368/113 |
| 4,367,051 | 1/1983 | Inoue | 368/111 |
| 4,657,405 | 4/1987 | Nakazawa | 368/110 |
| 4,831,605 | 5/1989 | Suga | 368/113 |
| 4,901,294 | 2/1990 | Aihara | 368/111 |
| 4,991,156 | 2/1991 | Suga | 368/113 |

OTHER PUBLICATIONS

Patent Abstracts of Japan, vol. 10, No. 169 (P-468) (2225) Jun. 14, 1986.

*Primary Examiner*—Vit W. Miska

*Attorney, Agent, or Firm*—Bruce L. Adams; Van C. Wilks

[57] ABSTRACT

An electronic timepiece with timer function comprising a stopwatch counting means operated from the signal from an input means, timer subtraction counting means for making subtraction from an arbitrary set value in the interlocking arrangment with said stopwatch counting means, an interrupt controller for outputting starting signal to said stopwatch counting means and said timer subtraction counting means, wait time counting means for counting the time from time-up to a lap time processing when the signal from said input means is the lap time processing of stopwatch time counting and the time of said subtraction timer is up before said lap time processing, and counting means for counting the time till time-up when said lap time processing is before said time-up.

The timepeice can let the runner of the marathon and the like know easily the delay and advance from the set timer set by him.

7 Claims, 5 Drawing Sheets

ELECTRONIC TIMEPIECE WITH TIMER

BACKGROUND OF THE INVENTION

The present invention relates to an electronic timepiece with timer function.

In an electronic timepiece using LSI consisting fundamentally of RAM for storing a counted time of a stopwatch and a subtraction time of a timer, ROM for storing the program of operation sequences of the stopwatch and the like and CPU for making logical calculation processing, this invention relates to means for counting the time of the stopwatch and means for counting the subtraction time of the timer.

In conventional electronic wrist watches, stopwatch and timer function have been built in the past, but they are mutually separate functions. A well known, so-called "pitch meter" alert a user by means of sound generation or the like when a predetermined interval that is designated by the user has elapsed.

When one runs a marathon race with an electronic wrist watch with a built-in stopwatch function, for example, he attempts to distribute his pace and to challenge the record by counting the LAP time for every 5 km. It is a great burden for the runner to have to continuously look at the wrist watch to measure his pace. It is also a burden for the runner to have to calculate in his mind his pace and the LAP time while running.

SUMMARY OF THE INVENTION

In order to solve the problem described above, the present invention disposes means for setting a timer setting time and split-timing means which operates in an interlocking arrangement with the input means described above for operating the stopwatch counting means described above.

Since the present invention disposes the stopwatch counting means and the input means for operating the timer subtraction counting means in an interlocking arrangement, the present invention can easily let the runner of a marathon and the like know his delay or advance from the desired pace set by him. The user merely has to input the completion of an actual lap interval during his run and a split time processing operation determines his pace progress.

DETAILED DESCRIPTION OF THE PREFERRED EMBODIMENT

Figure 1:
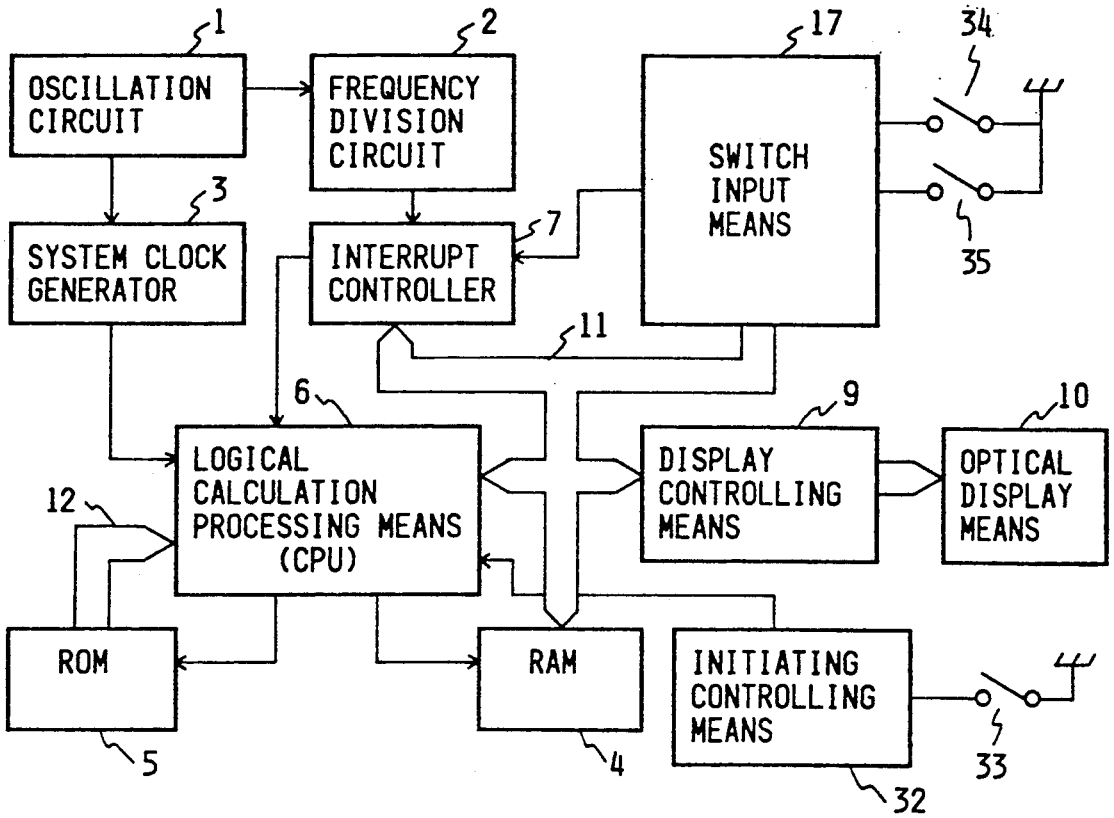
FIG. 1 i s a block diagram showing an embodiment of the present invention.

FIG. 1 is a block diagram showing an embodiment of the present invention.

The oscillated signal of oscillation circuit 1 is outputted to the frequency division circuit 2 and the system clock generater 3. The system clock generater generates timing clocks for the operation of the system.

The signal of switch A 34 and switch B 35 are outputted to the switch input means 17.

The switch signal of switch input means 17 and the divided signal of the frequency division circuit 2 are outputted to the interrupt controller 7. The interrupt controller 7 outputs a starting signal to the logical calculation processing means (CPU) 6.

The RAM 4 counts and stores time information such as stopwatch, timer, etc. The ROM 5 stores the instruction programing for the operation sequence of the functions such as stopwatch, timer, etc. The logical calculation processing means 6 calculates the time information of stopwatch, timer, etc., and outputs the time signal to the display controlling means 9 and displays time information by the optical display means 10.

The initiating controlling means 32 initiates the logical calculation means 6 by switching of switch means 33.

Figure 2:
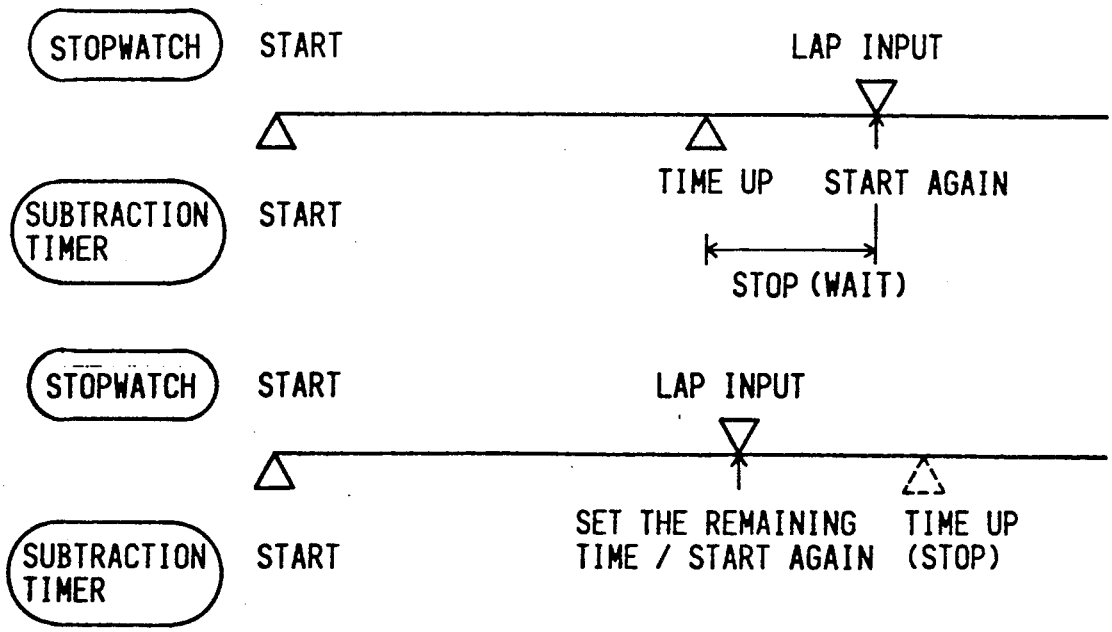
FIG. 2 is a timing chart showing the operation sequence of the embodiment of the present invention.
Figure 3:
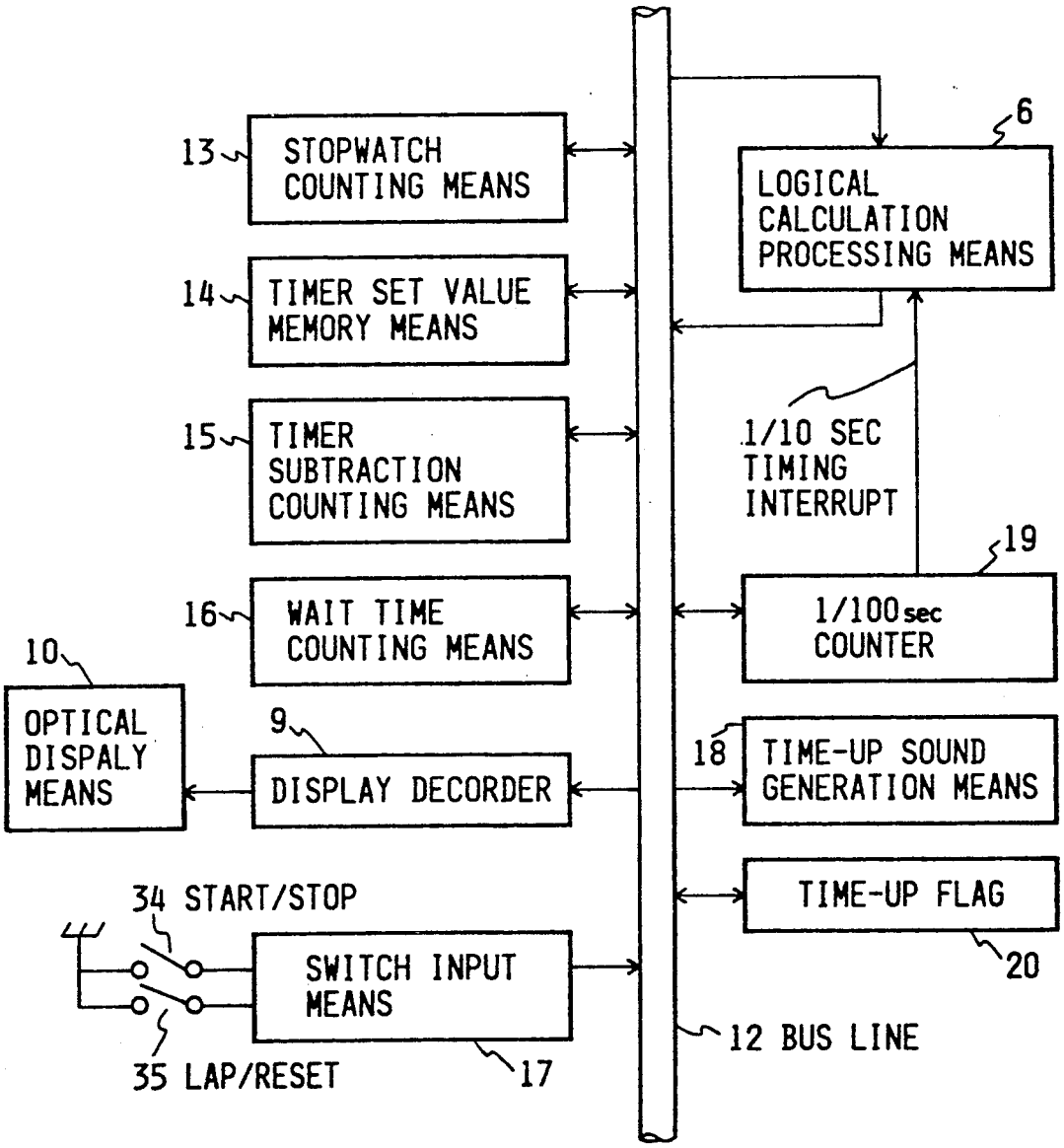
FIG. 3 is a block diagram showing the embodiment of the present invention.
Figure 4:
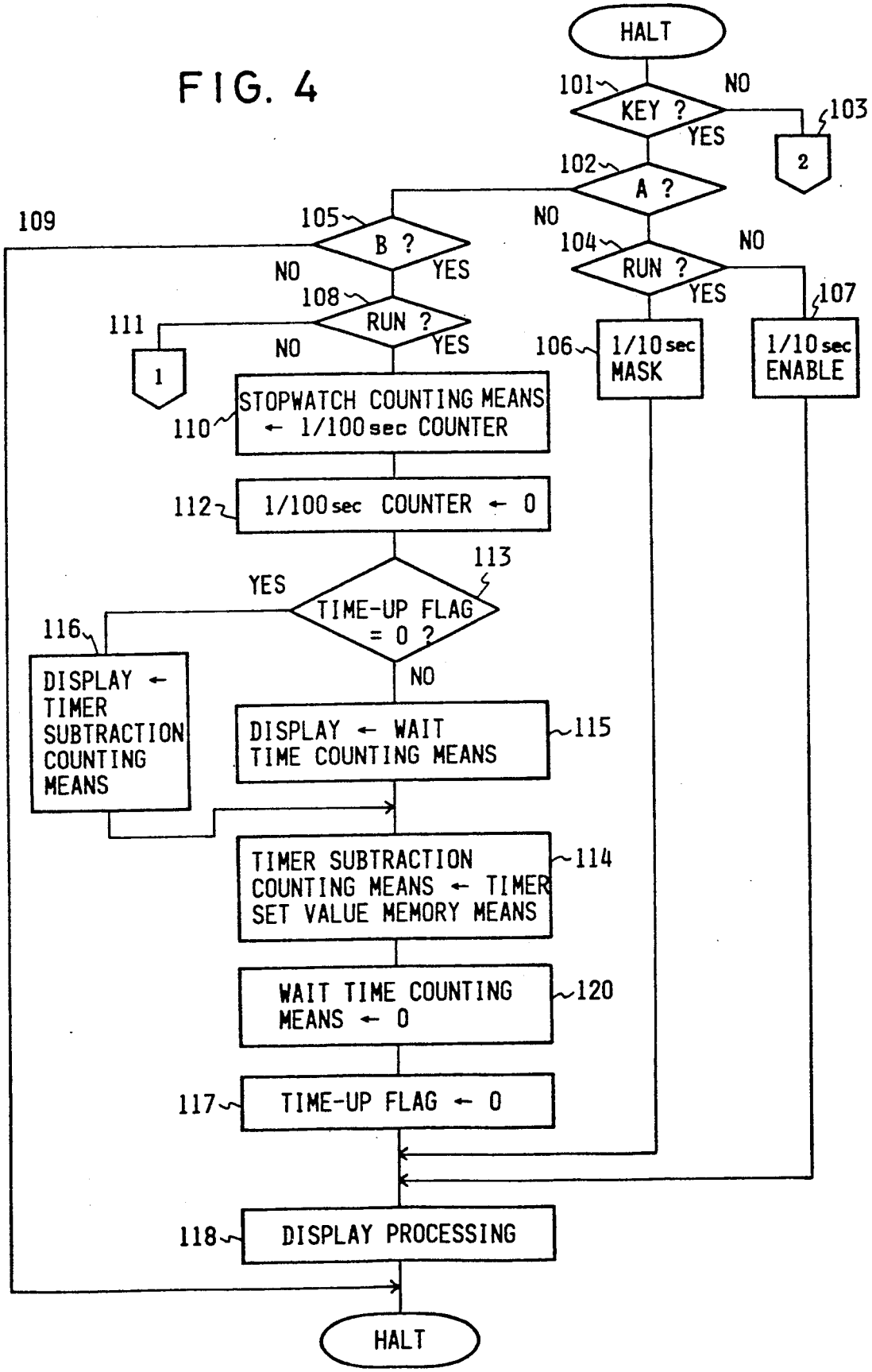
FIG. 4, FIG. 5 and FIG. 6 are flowcharts each showing the processing sequence of the embodiment of the present invention.
Figure 5:
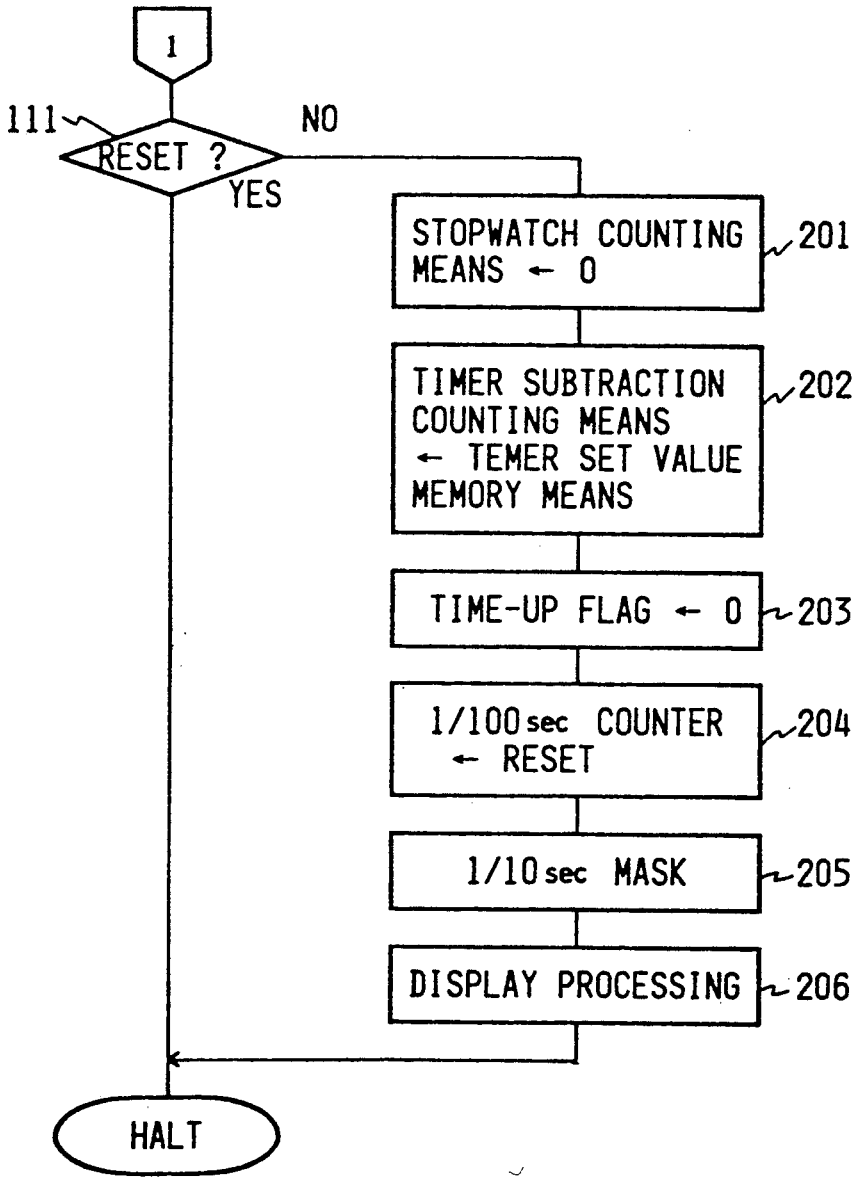
Figure 6:
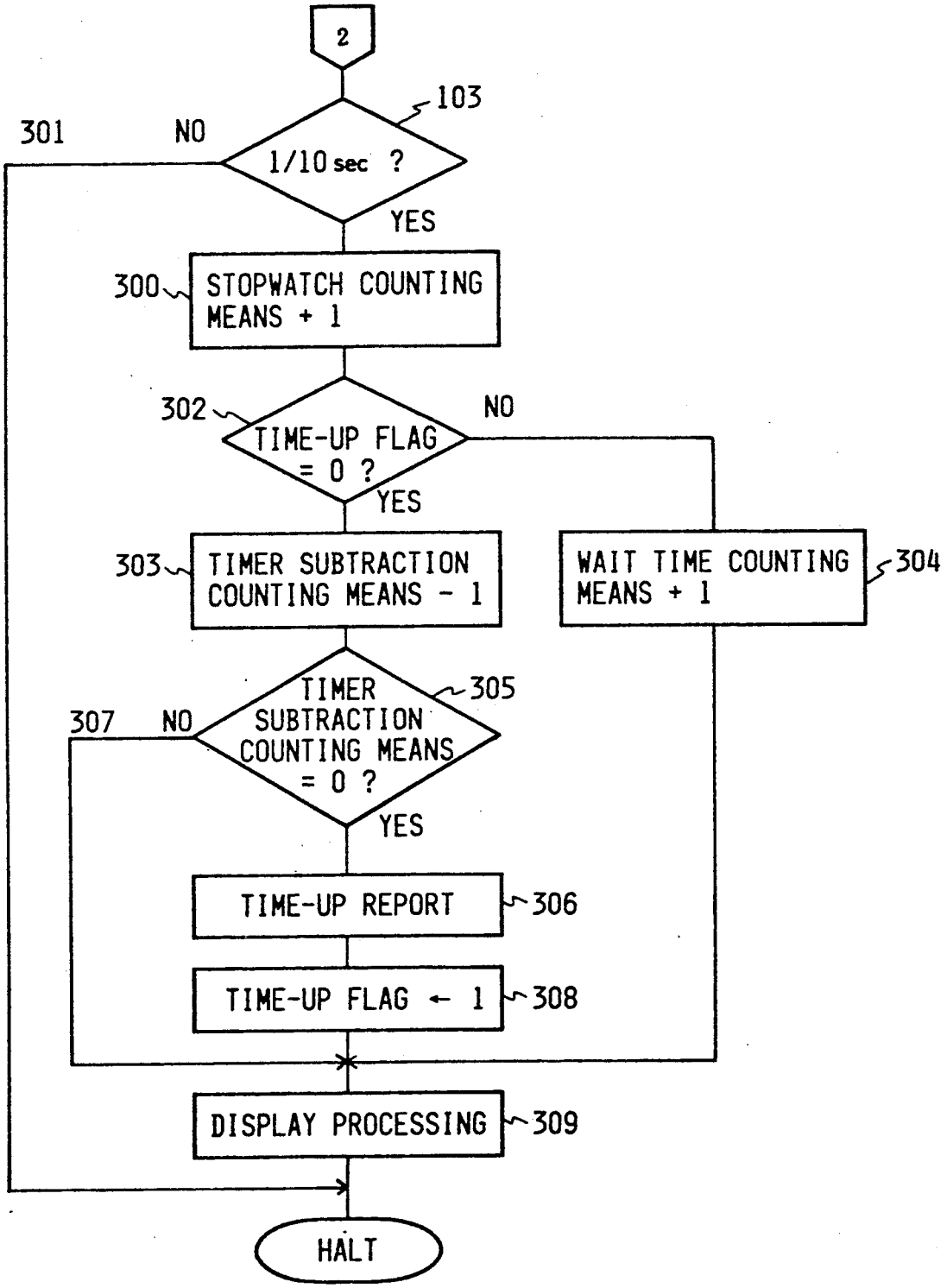

FIG. 2 is a timing chart showing the operation sequence of the embodiment of the present invention, FIG. 3 is a block diagram showing the embodiment of the present invention and FIG. 4, FIG. 5 and FIG. 6 are detailed flowchart of the operation sequence of the embodiment of the present invention.

First of all, the flow of the operation sequence will be explained with reference to the timing chart in FIG. 2 which shows the operation sequence of the embodiment of the present invention. When the stopwatch is activated, a split-timing means having a subtraction timer is simultaneously started. The subtraction timer stops counting when the time passes from the beginning of the counting by the subtraction timer to the set value. This is time-up. On receiving the input for LAP, that is for counting a split time, in the stopwatch, the subtraction timer starts subtraction from the set value. When the subtraction timer receives the input for LAP in the stopwatch before its time-up, the subtraction timer stores the remaining time and again starts subtraction from the set value.

Next, the operation of the block diagram of FIG. 3 showing the embodiment of the present invention will be explained with reference to the sequence of the detailed flowchart of the operation sequence of the embodiment shown in FIG. 4, FIG. 5 and FIG. 6.

The explanation will be given for the case where the switch A 34 is inputted under the state where the stopwatch is reset (stop). When the switch A 34 is input, the processing 101 that leaves HALT judges whether it is key input and if it proves Yes, the flow branches to 102. The switch input means 17 is read through the bus line 12 and judged by logical calculation processing means 6. The flow branches to 104 and since the mode is Stop, the flow branches to the processing 107, where a 1/10 sec timing interrupt is enabled (released) so as to bring the stopwatch into a RUN state. The same routine is followed when the stopwatch is STOP. When the stopwatch is under the RUN state, the flow branches from the processing 104 to 106 where the stopwatch is stopped (STOP) by use of the 1/10 sec timing interrupt as the mask.

Next, the description will be made in the case where the switch B 35 is inputted. When the stopwatch is under the RUN state, the processing is LAP processing. The flow branches from the processing 102 to 105 and since the input is the input of the switch B 35, it branches to 108. If it is not the input of the switch B 35, the flow branches to 109, where the flow enters HALT. The flow branches to 108 and since the stopwatch is under the RUN state, the data of the 1/100 sec counter 19 is written into the stopwatch counting means 13 through the bus line 12. Then, "0" is written to the 1/100 sec counter at the processing 112 for resetting. At the processing 113, the time-up flag 20 is read through the bus line 12 and the logical calculation means 6 judges whether its value is "0" or "1". If it is "0", the flow branches to 116 and if it is "1", to 115. When the data of the time up flag 20 is "0", the count value of the timer subtraction counting means is displayed in step 116. When the data of the time up flag 20 is "1", the count value of the wait time counting means is displayed in step 115. If the information of the time-up flag 20 is "1" in the processing 113 described above, the flow branches to the processing 115, where the data of the timer set value memory means 14 is read to the logical calculation processing means 6 through the data line 12 and the data of the stopwatch counting means 13 is inputted to the logical calculation processing means 6 through the bus line 12 so as to make the subtraction. The result of the calculation is written into the WAIT time counting means 16 through the bus line 12 and the flow then shifts to the processing 114. The data from the timer set value memory means 14 is written into the timer subtraction counting means 15 through the bus line in step 114. Step 117 sets the value of the time up flay to "0". The count value of the wait time counting means is processed to be "0" in step 120.

When the stopwatch is at STOP, the processing is RESET processing and the flow branches from the processing 108 described above to the processing 111. Referring to FIG. 5, if the state is STOP in the processing 111, the flow branches to processing 201 and if it is RESET, the flow branches to HALT. In the processing 201, "0" is written into the stopwatch counting means 13 and in the processing 202, the data of the timer set value memory means 14 is written into the timer subtraction counting means 15 through the bus line 12. In the processing 203, "0" is written into the time-up flag 20, the 1/100 sec counter 19 is reset in the processing 204 and 1/10 sec timing interrupt is set to the mask in the processing 205.

Next, the processing for counting in the RUN state of the stopwatch will be explained. When the stopwatch is under the RUN state, the 1/10 sec timing interrupt is enabled and the interrupt request is permitted. Therefore, flow leaves HALT and branches from the processing 101 to 103. Referring to FIG. 6 in the processing 103, whether or not the interrupt request is the 1/10 sec timing interrupt is judged, and when it is Yes, the flow proceeds to the processing 300 and when it is No, to HALT of 301. In the processing 300, 1 is added to the stopwatch counting means 13 and in the processing 302, the data of the time-up flag 20 is read and judged through the bus line 12. When the data of the time-up flag 12 is "0", the flow proceeds to the processing 303 and when it is "1", the flow branches to the processing 304. Since this processing 304 is after the time-up, 1 is added to the data of the WAIT time counting means 16. In the processing 303, 1 is subtracted from the timer subtraction counting means 15 and in the processing 305, whether or not the data of the timer subtraction counting means 15 is "0" is judged by the logical calculation processing means 6 through the bus line 12. When the data of the timer subtraction counting means 15 is "0", the time is up and the flow proceeds to the processing 306 and if it is not "0", the flow branches to the processing 307. In the processing 306, the report data is written into the time-up report means 19 as the time-up report processing. In the processing 308, "1" is written into the time-up flag 20.

In the display processing in the processings 118, 206 and 309, the data of the respective means are sent to the display decoder 9 through the bus line 12 and the data converted in the form of numeric values are sent to and displayed by the optical display means 10. After the display processings 118, 206 and 309 are complete, the flow returns to HALT.

As described above, in accordance with the present invention, the timer subtraction counting means is operated in the interlocking arrangement by the switch input for the stopwatch operation. Since delay and advance from the timer set time set by the user can be displayed, the user can know necessary information with a smaller number of operations during a marathon race, or the like.

In this embodiment, one timer set value memory means is shown used but a plurality of them can be used, too. If the data of the stopwatch counting means and wait time counting means are stored, cumulative pace characteristics can be computed and displayed during the run and the stored data can also be used to make data analysis after the end of the race.

What is claimed is:

1. An electronic timepiece with timer function comprising: an oscillation circuit using a quartz oscillator as an oscillation source; a frequency division circuit for frequency-dividing the output of said oscillation circuit; storing means for storing time data; a system clock generator for generating system clocks for operation of the timepiece; input means for inputting control signals including a stopwatch counting signal and a split time processing signal; display means for displaying output time data; stopwatch counting means operated from the stopwatch counting signal from said input means; timer set value memory means for storing time information including a timer set value; timer subtraction counting means for making subtraction from the timer set value in an interlocking arrangement with said stopwatch counting means and producing a subtraction timer value and a time-up signal when the subtraction timer value represents zero time; an interrupt controller for outputting a starting signal to said stopwatch counting means and said timer subtraction counting means; wait timer counting means for determining the time from the time-up signal to a split time processing operation which begins when the signal from said input means is the split time processing signal and the time-up signal is produced before the split time processing signal is received; and counting means for determining the time remaining before the subtraction timer value represents zero time when said split time processing signal is received before the time-up signal is produced.

2. An electronic timepiece according to claim 1 wherein said subtraction timer means can be reset to determine the time in an interlocking arrangement with said stopwatch counting means.

3. A electronic timepiece according to claim 1; further comprising resetting means operational with split time processing signal for resetting said timer subtraction counting means with the timer set value, stopwatch counting means with a reset value, and wait time counting means with a reset value.

4. A timepiece for determining the difference between an actual lap interval and a preset time value comprising: stopwatch means for timing the duration of an event, and producing stopwatch counting data that is time dependent; split-timing means operative in interlocking relation with the stopwatch means for determining the difference between the actual lap interval and the preset value; lap input means operable by a user for producing a lap signal; computing means responsive to the lap signal for computer the difference between the actual lap interval and the preset value and producing a display signal in response thereto, the computing means including timer set value memory means for storing the preset value, timer subtraction counting means receptive of the preset value for subtracting from the preset value in a time dependent manner and producing a subtracted preset value signal in response thereto, deciding means responsive to the subtracted set value signal for producing a time-up signal in response thereto, timer information computing means receptive of the time-up signal for producing the display signal in response thereto dependent on either the subtracted preset value signal or a computer subtraction value based on the stopwatch counting data and the set value, and reset means for resetting the timer subtraction counting means, the stopwatch counting data and the deciding means and being operative in response to the lap signal; and display means responsive to the display signal for displaying time information.

5. A timepiece according to claim 4; wherein said computing means further includes data storage means for storing time information in a cumulative manner including the stopwatch counting data, the lap signal, the time-up signal and the display signal, and means for computing overall time information dependent on the stored time information.

6. A timepiece according to claim 4; wherein the timer set value memory means includes a plurality of memory means for storing respective preset time value; and said computing means further includes selecting means operative in response to the lap signal for selecting one of said plurality of memory means to be the source of the preset value that is received by said timer subtraction counting means.

7. A timepiece according to claim 4; wherein the display means includes means for producing an optical display.

* * * * *